United States Patent [19]

Ruger

[11] 4,063,379

[45] Dec. 20, 1977

[54] FORE END ASSEMBLY FOR A FIREARM

[75] Inventor: William B. Ruger, Southport, Conn.

[73] Assignee: Sturm, Ruger & Co., Inc., Southport, Conn.

[21] Appl. No.: 674,880

[22] Filed: Apr. 8, 1976

[51] Int. Cl.[2] ..... F41C 23/00

[52] U.S. Cl. ..... 42/75 D

[58] Field of Search ..... 42/75 D

[56] References Cited

U.S. PATENT DOCUMENTS

| | | | |
|---|---|---|---|
| 694,654 | 3/1902 | Lewis | 42/75 D |
| 766,231 | 8/1904 | Elterich | 42/75 D |
| 1,029,229 | 6/1912 | Russell | 42/75 D |
| 1,029,374 | 6/1912 | Kremer et al. | 42/75 D |

*Primary Examiner*—Charles T. Jordan
*Attorney, Agent, or Firm*—Pennie & Edmonds

[57] ABSTRACT

A firearm of the break-open and take-down type has a frame, at least one barrel releasably mounted on the frame, and a fore end assembly releasably secured to the underside of the barrel. The fore end assembly comprises a wooden fore end stock having a channel-shaped transverse cross-section, a metal latch plate removably secured to the bottom wall of the fore end stock, and latch means mounted on the latch plate for releasably securing the fore end assembly to the underside of the barrel. The latch plate has a downwardly extending latch mechanism portion and the inner surface of the bottom wall of the fore end stock is formed with a longitudinally disposed latch plate receiving opening in which the latch mechanism portion of the latch plate is snugly received. The forward facing rearward end wall of the latch plate receiving opening and the abutting rearward facing rearward end wall of the latch mechanism portion of the latch plate are substantially planar and extend vertically the full depth of the bottom wall of the fore end stock and are disposed substantially perpendicular to the longitudinal centerline of the firearm.

5 Claims, 6 Drawing Figures

FORE END ASSEMBLY FOR A FIREARM

BACKGROUND OF THE INVENTION

1. Field of the Invention

This invention relates to break-open firearms of the take-down type, and in particular it relates to an improved fore end assembly for such firearms.

2. Prior Art

Broadly, the term "break-open take-down firearm" includes all firearms that have one or more barrels releasably mounted on the frame or receiver of the firearm, the barrel or barrels being rotatable from their closed and locked ready-to-fire position to their open loading-and-unloading position, and return, as required by the shooter. Such firearms are designed so that they can be diassembled into two or more parts or subassemblies (for example, a barrel assembly, a stock assembly and a fore end assembly) for convenience in cleaning, storing and transporting the firearm, and they include single and double barreled rifles and shotguns and combinations thereof (including both side-by-side and over-and-under types).

In break-open take-down firearms of the type to which the present invention relates the barrel assembly is releasably mounted on the forward end of the frame which advantageously comprises a part of the stock assembly, and the fore end assembly is releasably secured to the underside of the barrel assembly. The fore end assembly comprises a wooden fore end stock having a channel-shaped transverse cross section, a metal latch plate removably secured to the bottom wall of the fore end stock, and latch means mounted on the latch plate for releasably securing the fore end assembly to the underside of the barrel assembly. The bottom wall of the fore end stock is formed with a latch plate receiving opening, and the latch plate is provided with a latch mechanism portion that is received in the latch plate receiving opening of the fore end stock. The latch plate is normally secured to the inner surface of the fore end stock by one or more screws and, advantageously, by the mutual engagement of matching arcuate surfaces located at the rearward ends of the fore end stock and the latch plate.

When the firearm is fired, the recoil of the barrel assembly and the opposing inertial forces of the fore end assembly cause the rearward end of the latch mechanism portion of the latch plate to impact heavily against the abutting rearward surface of the latch plate receiving opening of the fore end stock. Accordingly, to minimize possible damage to these parts, the latch mechanism portion of the latch plate should fit snugly in the latch plate receiving opening formed in the bottom wall of the fore end stock. To facilitate this snug fit the abutting end surfaces of the latch mechanism portion and the latch plate receiving opening have heretofore had a smoothly contoured arcuate configuration (for example, a semi-cylindrical configuration) at both the forward and rearward ends thereof. However, although this practice ensures a snug initial fit of the engaged parts, repeated firing with consequent repeated impact of the convex arcuate rearward surface of the latch mechanism portion of the latch plate against the concave arcuate rearward surface of the latch plate receiving opening of the wooden fore end stock subjects the wooden fore end stock to transverse rending or tearing forces which tend eventually to cause the wood to split or crack at this point. The resulting damage to the fore end stock not only disfigures the stock but, in extreme cases, may require replacement of this part.

The metal latch plate has heretofore commonly been made up of a number of separate metal parts that either must be fitted together before being fastened to the wooden fore end stock or are fastened separately to the fore end stock. The multiple parts of the metal latch plate complicate the assembly and disassembly of the fore end sub-assembly and tend to increase the difficulty in preventing damage to the wooden fore end stock when the firearm is fired. After an intensive investigation of this and related problems, I have found that damage to the fore end stock caused by the impact of the metal latch plate thereagainst when the firearm is fired can be substantially completely eliminated by constructing the latch plate in one integral piece and by providing transversely disposed planar, as opposed to curved, abutting surfaces at the principal point of impact of the one-piece metal latch plate against the wooden fore end stock.

SUMMARY OF THE INVENTION

The break-open take-down firearm to which the present invention relates has a frame, at least one barrel, and a fore end assembly releasably secured to the underside of the barrel, the fore end assembly and the barrel releasably secured thereto being pivotally mounted on the forward end of the frame. The fore end assembly comprises a wooden fore end stock having a channel-shaped transverse cross-section, a metal latch plate removably secured to the bottom wall of the fore end stock, and latch means mounted on the latch plate for releasably securing the fore end assembly to the underside of the barrel. The metal latch plate has an elongated main body portion, a latch mechanism portion disposed intermediate the forward and rearward ends of the main body portion, and a latch plate head portion disposed at the rearward end of the main body portion of the latch plate. The bottom wall of the wooden fore end stock is formed with a latch plate receiving opening. The latch mechanism portion of the latch plate extends downwardly below the level of the under surfaces of the forward and rearward ends of the main body portion of the latch plate, the downwardly extending latch mechanism portion being adapted to be snugly received in the latch plate receiving opening formed in the fore end stock. The latch plate receiving opening of the fore end stock and the latch mechanism portion of the latch plate are formed with longitudinally extending vertical side walls that are disposed substantially parallel to each other and to the longitudinal center line of the firearm. The forward facing rearward end wall of the latch plate receiving opening of the fore end stock and the abutting rearward facing rearward end wall of the latch mechanism portion of the latch plate extend vertically the full depth of the bottom wall of the fore end stock, said vertically disposed abutting end walls being substantially planar and being disposed substantially perpendicular to the longitudinal center line of the firearm.

The rearward end of the latch plate head portion of the latch plate is advantageously formed with rearward facing concave arcuate surfaces adapted to receive corresponding forward facing convex arcuate surfaces formed on the forward end of the frame. Similarly, the rearward end of the fore end stock is advantageously formed with rearward facing concave arcuate surfaces in which corresponding forward facing convex arcuate surfaces of the latch plate head portion are received.

The latch mechanism comprises a latch lever pivotally mounted on the latch mechanism portion of the latch plate and spring means urging the latch lever to its latched position, the latch lever advantageously being of unitary or one-piece construction. The forward end of the main body of the latch plate is removably secured to the fore end stock advantageously by means of a screw and escutcheon assembly. The inner surface of the bottom wall of the fore end stock is advantageously formed with an elongated recess that is adapted to receive the elongated main body portion of the latch plate.

BRIEF DESCRIPTION OF THE DRAWINGS

The improvement in the fore end assembly for break-open take-down firearms will be better understood from the following description thereof in conjunction with the accompanying drawings of which.

DESCRIPTION OF THE PREFERRED EMBODIMENT

Figure 1:
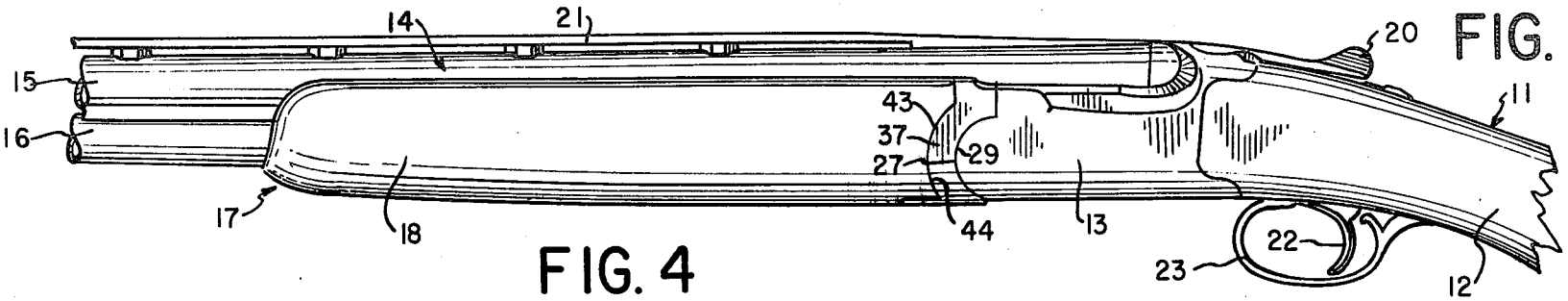
FIG. 1 is a fragmentary side elevation of an over-and-under shotgun embodying the fore end assembly of the invention.

The break-open firearms to which the present invention relates are of the take-down type that can be disassembled into two or more sub-assemblies (for example a stock assembly, a barrel assembly, and a fore end assembly), and they include single and double barreled rifles and shotguns and combinations thereof (including both side-by-side and over-and-under types). The improved fore end assembly of the invention will be described in conjunction with the over-and-under shotgun shown in the drawings but is not limited to this particular firearm.

As shown best in FIG. 1 of the drawings, the over-and-under shotgun embodying the invention has a stock assembly 11 that includes the stock 12 and the frame 13, a barrel assembly 14 that includes the upper barrel 15 and the lower barrel 16, and a fore end assembly 17 that includes the fore end stock 18 and metal latch plate 19. The fore end assembly 17 is releasably secured to the lower barrel 16 of the barrel assembly 14 as hereinafter described, and these two assemblies are pivotally mounted on the forward end of the frame 13 of the stock assembly 11 so that the barrels can be rotated from their closed position as shown in FIG. 1 to their open position (not shown), as required by the shooter. A top lever 20 is pivotally mounted on the frame 13 for operating the barrel assembly locking mechanism, and a ventilated sight rib 21 is secured to the upper surface of the upper barrel 15. Also mounted on the frame 13 are the trigger 22, trigger guard 23 and other parts of the firing mechanism (not shown).

The inner surfaces of the right and left hand side walls of the frame 13 are integrally formed with inner pivot lugs 25 (shown in outline in FIG. 2), and the adjacent right and left hand sides of the barrel assembly 14 are formed with matching inner pivot bearing recesses (not shown) having forward facing concave bearing surfaces that are adapted to receive the rearward facing convex bearing surfaces of the inner pivot lugs 25. In addition, the forward ends of the right hand and left hand side walls of the frame 13 are formed with forward facing convex arcuate surfaces 27, and the corresponding rearward ends of the latch plate 19 are formed with matching rearward facing concave arcuate surfaces 29 that are adapted to receive the forward facing arcuate surfaces 27 of the frame 13. When the three sub-assemblies of the shotgun are assembled together as shown in FIG. 1, the fore end stock 18 is secured to the lower barrel 16 by means of the fore end latch mechanism as hereinafter described, the inner pivot lugs 25 of the frame 13 are received in the inner pivot bearing recesses of the barrel assembly 14 and the convex arcuate surfaces 27 of the frame 13 are received in the concave arcuate surfaces 29 of the latch plate 19. The barrel assembly 14 and the fore end assembly 17 are thereby pivotally mounted on the forward end of the frame 13 of the stock assembly 11 so as to permit the barrels to be rotated from their closed position (as shown) to their open position (not shown) in the manner known in the art. The shotgun is disassembled into its three constituent sub-assemblies by unlatching and removing the fore end assembly 17, whereupon the barrel assembly 14 can readily be separated from the stock assembly 11 in the manner also known in the art.

As noted, the stock assembly 11, the barrel assembly 14 and the fore end assembly 17 are releasably secured together. The frame of the stock assembly and the barrels of the barrel assembly together contain and oppose the forces generated by the powder combustion gases and by the projectiles expelled forwardly from the barrel or barrels when the shotgun is fired. As a result, the stock assembly 11 and the barrel assembly 14 recoil sharply rearwardly, and the fore end assembly 17 is moved or jerked sharply rearwardly, when the shotgun is fired. The fore end assembly 17 has a metal latch plate that is releasably secured to the underside of the barrel 16, and it has a wooden fore end stock that is secured to the metal latch plate, the latch plate having a latch mechanism portion that is received in an opening formed in the bottom wall of the fore end stock. As a result, the rearward facing surfaces of the latch mechanism portion of the latch plate impact sharply against the opposing forward facing surfaces of the fore end stock when the shotgun is fired, thereby tending to cause the wooden fore end stock to crack or split at this point, as hereinbefore explained.

Figure 4:
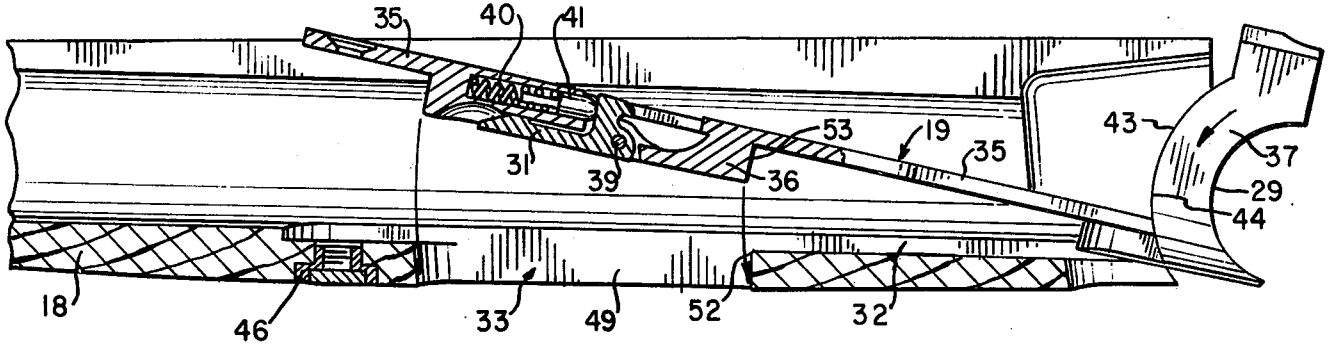
FIG. 4 is a fragmentary side elevation, partly in section, with the barrels and frame removed and showing the latch plate being removed from the fore end stock.
Figure 6:
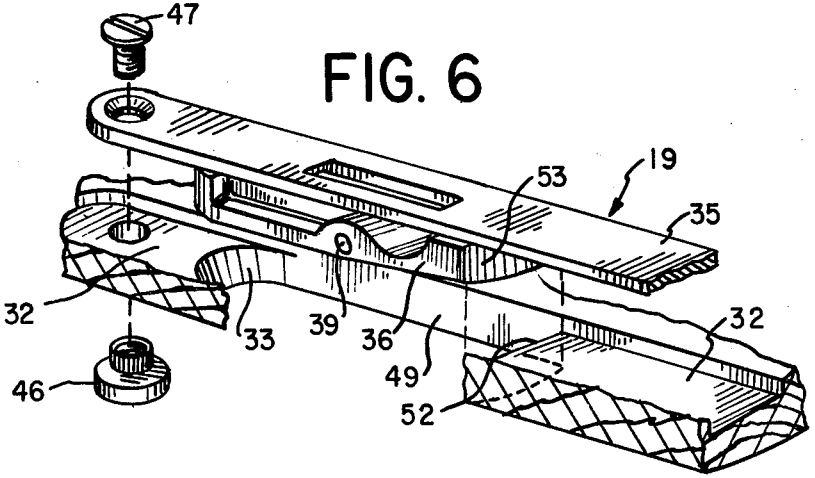
FIG. 6 is an exploded perspective view of the forward end and latch mechanism portions of the latch plate with the corresponding portion of the fore end stock.
Figure 5:
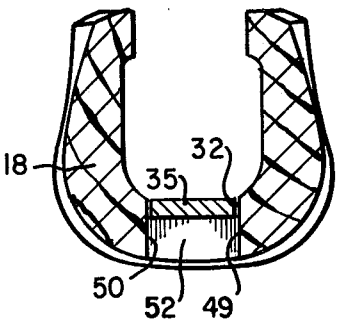
FIG. 5 is a section along line 5–5 of FIG. 2 with the barrels and frame removed.
Figure 2:
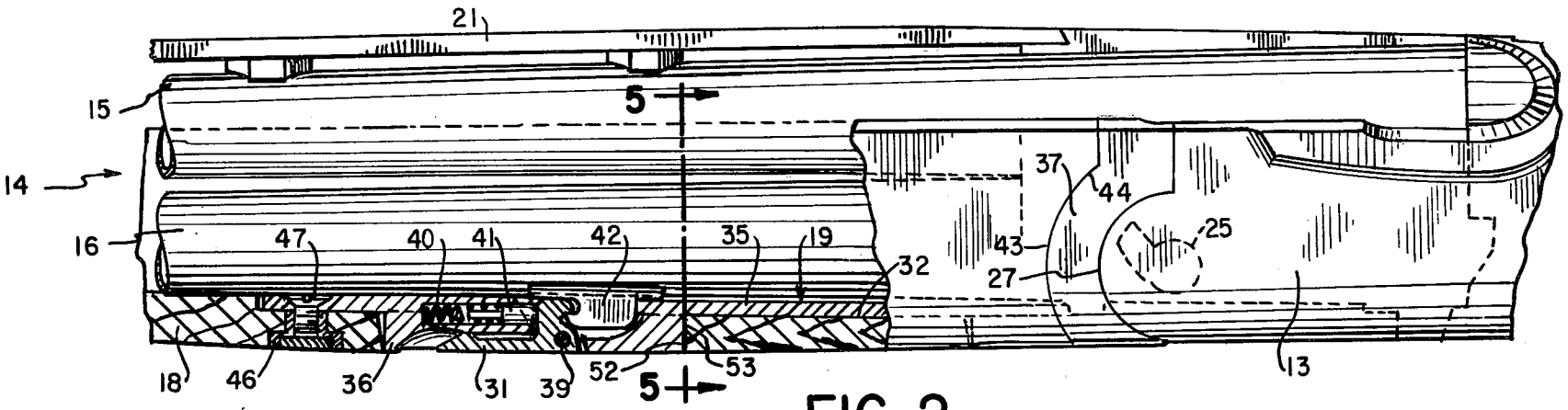
FIG. 2 is an enlarged fragmentary view, partly in section, of the fore end assembly shown in FIG, 1.
Figure 3:
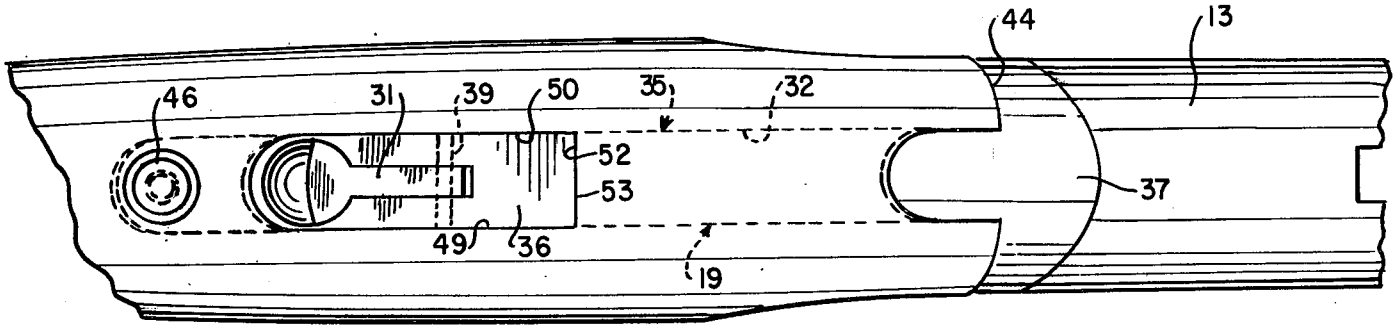
FIG. 3 is a fragmentary view from below of the fore arm assembly shown in FIGS. 1 and 2.

In the improved fore end assembly of the invention, damage to the wooden fore end stock caused by impact of the metal latch plate thereagainst when the shotgun is fired is substantially completely eliminated by constructing the latch plate in one integral piece and by providing transversely disposed planar abutting surfaces at the principal point of impact of the latch plate against the fore end stock. Specifically, as shown best in FIGS. 2, 3 and 4 of the drawings, the fore end assembly 17 comprises the wooden fore end stock 18, the metal latch plate 19 removably secured to the bottom wall of the fore end stock, and latch means 31 mounted on the latch plate 19 for releasably securing the fore end assembly to the underside of the barrel 16. The fore end stock 18 has a channel-shaped transverse cross-section shown best in FIG. 5, the bottom wall of the fore arm stock being formed with a longitudinal recess 32 and with a latch plate receiving opening 33 shown best in FIGS. 2, 4 and 6. The metal latch plate 19 is integrally formed in one piece and has an elongated main body portion 35, a latch mechanism portion 36 disposed intermediate the forward and rearward ends of the main body portion 35, and a latch plate head portion 37 disposed at the rearward end of the main body portion 35 of the latch plate. The latch means 31 is pivotally mounted on the latch mechanism portion 36 of the latch plate by the pivot pin 39, the latch means 31 being urged to its latched position by the latch spring 40 and spring plunger 41 at which position it engages latch lug 42 secured to the barrel 16 as shown in FIG. 2.

The latch mechanism portion 36 of the latch plate 19 extends downwardly below the level of the under surfaces of the forward and rearward ends of the main body portion 35 of the latch plate. The forward and rearward ends of the main body portion 35 of the elongated latch plate are adapted to be received in the longitudinal recess 32 formed in the inner surface of the bottom wall of the fore end stock 18, and the downwardly extending latch mechanism portion 36 of the latch plate is adapted to be received in the latch plate receiving opening 33 also formed in the bottom wall of the fore end stock 18. The head portion 37 of the latch plate 19 is formed with forward facing convex arcuate surfaces 43 that are adapted to be received in matching rearward facing concave arcuate surfaces 44 formed in the side walls of the fore end stock 18. When the main body portion 35 and the latch mechanism portion 36 of the latch plate 19 are received in the longitudinal recess 32 and the latch plate receiving opening 33 of the fore end stock 18, respectively, the latch plate 19 is secured at its rearward end to the fore end stock 18 by the mutual engagement of the aforementioned matching convex and concave surfaces 43 and 44, and it is secured at its forward end to the fore end stock by means of the escutcheon 46 and screw 47, as shown best in FIG. 2.

As noted, the downwardly extending latch mechanism portion 36 of the latch plate 19 is adapted to be snugly received in the latch plate receiving opening 33 formed in the fore end stock 18. The longitudinally extending side walls 49 and 50 of the latch plate receiving opening 33 and of the latch mechanism portion 36 are disposed substantially parallel to each other and to the longitudinal center line of the shotgun. The forward facing transverse rearward end wall 52 of the latch plate receiving opening 33 and the abutting rearward facing transverse rearward end wall 53 of the latch mechanism portion 36 are substantially planar and extend the full depth of the bottom wall of the fore end stock 18, said rear end walls 52 and 53 being disposed substantially perpendicular to the longitudinal center line of the shotgun.

The one-piece construction of the latch plate 19 eliminates the problems associated with the fitting together and mounting of the multi-piece latch plates on the fore end stocks of the prior art, and it substantially reduces the probability of damage to the wooden fore end stock 18 by concentrating or localizing the impact of the metal latch plate against the fore end stock at one relatively large area of contact between the two parts. Moreover, and most important, this area of contact is flat and is disposed perpendicular to the direction of the force of impact of the latch plate against the fore end stock. That is to say, when the shotgun is fired the full force of the impact of the latch plate against the fore end stock is confined to the rearward facing transverse rear end wall 53 of the latch mechanism portion 36 of the latch plate 19 and to the abutting forward facing transverse rear end wall 52 of the latch plate receiving opening 33 of the fore end stock 18. The force of the impact is thereby uniformly distributed over the planar transverse surfaces of the abutting end walls 52 and 53 so that there is no tendency whatever for the latch plate 19 to crack or split the fore end stock 18 at this point.

I claim:

1. In a break-open firearm having a frame, at least one barrel pivotally mounted on the frame, and a fore end assembly releasably secured to the underside of the barrel; the fore end assembly comprising a wooden fore end stock having a channel-shaped transverse cross-section and a latch plate receiving opening formed in the bottom wall thereof, a metal latch plate removably secured to the bottom wall of said fore end stock, and latch means mounted on the latch plate for releasably securing the fore end assembly to the underside of the barrel;

the improvement which comprises an integrally formed metal latch plate having an elongated main body portion, a latch mechanism portion disposed intermediate the forward and rearward ends of the main body portion and a head portion disposed at the rearward end of the main body portion of the latch plate, the latch mechanism portion extending downwardly below the level of the under surfaces of the forward and rearward ends of the main body portion of the latch plate and being adapted to be snugly received in the latch plate receiving opening formed in the fore end stock; the latch plate receiving opening of the fore end stock and the latch mechanism portion of the latch plate being formed with longitudinally extending vertical side walls that are disposed substantially parallel to each other and to the longitudinal centerline of the firearm, the transverse forward facing rear end wall of said latch plate receiving opening and the abutting transverse rearward facing rear end wall of said latch mechanism portion extending vertically the full depth of the bottom wall of said fore end stock and being substantially planar and disposed substantially perpendicular to the longitudinal centerline of the firearm.

2. The firearm according to claim 1 in which the inner surface of the bottom wall of the channel shaped fore end stock is formed with a shallow longitudinally disposed recess in which the elongated main body of the metal latch plate is adapted to be snugly received.

3. The firearm according to claim 1 in which the rearward end of the fore end stock is formed with rearward facing concave arcuate surfaces that are adapted to receive corresponding forward facing convex arcuate surfaces of the head portion of the latch plate.

4. The firearm according to claim 1 in which the forward end of the main body of the latch plate is removably secured to the fore end stock by means of a screw and escutcheon assembly.

5. The firearm according to claim 1 in which the latch means comprises a latch lever pivotally mounted on the latch mechanism portion of the metal latch plate and spring means urging the latch lever to its latched position.

* * * * *